US006871459B2

(12) United States Patent
Van Dame

(10) Patent No.: US 6,871,459 B2
(45) Date of Patent: Mar. 29, 2005

(54) ARTICLES OF MANUFACTURE FOR TRANSPORTING DAYLIGHT THROUGH BUILDING PLENUM

(76) Inventor: James Tyler Van Dame, 420 Rupard St., Lake Elsinore, CA (US) 92530

( * ) Notice: Subject to any disclaimer, the term of this patent is extended or adjusted under 35 U.S.C. 154(b) by 0 days.

(21) Appl. No.: 10/308,965

(22) Filed: Dec. 3, 2002

(65) Prior Publication Data

US 2003/0126811 A1 Jul. 10, 2003

Related U.S. Application Data

(60) Provisional application No. 60/336,638, filed on Dec. 3, 2001.

(51) Int. Cl.[7] ..... E04B 7/18

(52) U.S. Cl. ..... 52/200; 52/506.07; 52/745.16

(58) Field of Search ..... 52/200, 506.07, 52/745.16, 745.15

(56) References Cited

U.S. PATENT DOCUMENTS 4,702,056 A * 10/1987 Carey ..... 52/506.07
4,733,505 A * 3/1988 Van Dame ..... 52/22
4,809,468 A * 3/1989 Bareiss ..... 52/22
5,613,333 A * 3/1997 Witzig, Jr. ..... 52/200
5,655,339 A * 8/1997 DeBlock et al. ..... 52/200
5,715,636 A * 2/1998 Taylor ..... 52/308
6,035,593 A * 3/2000 Chao et al. ..... 52/200
6,363,667 B2 * 4/2002 O'Neill ..... 52/200
2003/0000158 A1 * 1/2003 Borges ..... 52/200

* cited by examiner

*Primary Examiner*—Peter M. Cuomo
*Assistant Examiner*—Joseph Edell

(57) ABSTRACT

Combining ceiling framework and structural members of skylight plenum enclosures in daylighting applications wherein the light shaft enclosures are designed to be suspended over a ceiling framework. Only the light reflective fabric of the light shaft connects to the ceiling. The light shaft thus floats above the ceiling framework and thereby has minimal impact on it. The light shaft is supported by the framework of the roof aperture by the rigid corner material that forms the light shaft.

15 Claims, 8 Drawing Sheets

22
29
28
12
24-a
16
16
41
27
26
12
13

ARTICLES OF MANUFACTURE FOR TRANSPORTING DAYLIGHT THROUGH BUILDING PLENUM

CROSS-REFERENCE TO RELATED APPLICATIONS

The present application claims the benefit of provisional application U.S. Ser. No. 60/336,638, filed on Dec. 3, 2001, the entire disclosure of which is incorporated by reference.

BACKGROUND OF THE INVENTION

1. Field of the Invention.

This invention relates generally to the field of building construction and more specifically to articles of manufacture for transporting daylight through building plenum.

2. Description of the Prior Art

Originally, daylighting with skylights could be found in building such as warehouses, for example, without ceilings between roof and floor. This form of daylighting had low requirements, with less need for tight design specifications as is now required by architects when designing complete building envelopes, with daylight as a primary factor. See analysis software called SkyCalc, at the following web site info@h-m-g.com, <mailto:info@h-m-g.com>. This software provides for analysis of electricity and money saved when daylighting buildings. California, in an effort to promote daylighting in commercial buildings, has awarded a skylight manufacturer Sola tube with incentives for installation of their products.

Previous studies have shown that skylighting, or toplighting with daylight, has dramatic potential for saving lighting energy (with cooling energy savings as a byproduct). These studies have shown examples of good (and sometimes bad) toplighting, but they have nearly all been one-of-a-kind designs.

In general, most practitioners are quite reluctant to take on the risk of developing one-of-a-kind designs for a ceiling system that must integrate several components from different manufacturers (skylight, ceiling and light well, electric lighting, photocell controllers, air diffusers, etc.). Applicant knows of no work that has proposed prototype designs, except in the most general sense, for integrated ceilings that could be standardized and repeatable. Preliminary discussions with Armstrong Ceilings, the largest manufacturer of ceiling systems in the country, indicates that neither they nor any other manufacturer of ceiling systems is likely to undertake this kind of integrated design development. They would, however, be willing to participate in the development of industry standards for integrating different manufacturers' products, provided there was leadership and impetus for such an effort. These standards would entail development of design standards and specifications for interconnection details between components (e.g. skylight-to-light-well connections, or photocell to controller-to-dimming-ballast connections).

About 60% of nonresidential floor space in California is directly under a roof, and 90% of new floor space is single story construction. There is, therefore, a huge potential floor area suitable for toplighting applications. Skylighting is not widely applied by building designers or owners because each skylighting design requires the careful integration of ceiling system, skylight, light shaft, electric lighting, photo control, and, often, air distribution systems. This problem has been discussed for over fifteen years within the building science community, yet the resources (federal or industry funding) has never materialized for this work to take place.

In both amounts of foot-candle requirements and control sophistication the daylighting of ceilings in buildings, including ceilings suspended from roof structures were not recognized as opportunities for daylighting, and existed outside the realm of affordable, or practicable daylighting, for numerous reasons. Some of these reasons are, existing physical obstructions restricting straight paths, for daylighting shafts, in vertical directions, and small semi-flexible shafts typical of tube type products lack the volume necessary to honestly turn off the building lights. In addition, the following factors have imbedded the adoption of daylighting by the mechanical or trades, integration of electric fixtures and other types of pipes, wires, ducting, general interior finish of suspended ceiling products, such as surface finish, non-interruptible wire connections from roofs to suspended ceilings, elements of the grid framework systems' resistance to impact by weight, movement, or deformity, process in which suspended ceiling installation requires complete assemblage, to provide dimensional integrity, effectively restricting installation labor, for light shaft installations, and resistance to removal and replacement of grid members.

The foundation, for the layout of the light fixtures, commonly referred to in the building trades as a reflected ceiling plan, is a design criteria driven by the requirements of electric lights, and their distribution throughout the utilized space. As a result, daylighting integration for suspended ceilings needs to be considered at the design stage of construction.

With current demands for energy efficiency and improved occupant living and working environments, as evidenced by published daylighting programs such as SkyCalc, and extensive daylighting studies indicating improvements in student scores, in day lit classrooms, there is a real need for the integration of daylighting processes and suspended ceiling applications.

Throughout the years, a number of innovations have been developed relating to skylight construction, and the following U.S. Pat. Nos. are representative of some of those innovations: U.S. Pat. Nos. 4,610,116; 4,788,804; 4,823,525; 5,044,133; and Des. 328,795. More specifically, U.S. Pat. Nos. 4,610,116, 4,788,804, 4,823,525, and 5,044,133 relate to roof-mounted skylights.

A skylight using a reflective fabric shaft has been described in U.S. Pat. No. 4,733,505. Skylight construction of various configurations has been discussed in the following U.S. Pat. Nos. 219,840; 3,012,375; 3,052,794; 3,064,851; 3,113,728; 3,130,922; 4,114,186; 4,161,918; 4,339,900; 4,365,449. The subject is also discussed in literature, Rodale's New Shelter, November/December 1983, Smart Skylights by Kathy Kukula, pp. 48–50, a brochure by Freeman Skyflex, 4 pgs., and a brochure by Kenergy Corp., 2 pgs.

SUMMARY OF THE INVENTION

The present invention provides for economies of material and installation processes, not addressed by the previous patents and literature in the areas of suspended ceilings, where skylight plenum enclosures and T-bar ceilings combine into a singular configuration. The economics are achieved by utilizing preassembled components to create site built systems that overcome most obstacles present in the complicated environment of the plenum above suspended ceilings.

The present invention utilizes a combination of building elements to create daylighting of building interiors. A plurality of sections of corner material of a length determined by the path of daylight from the roof aperture to a building interim aperture are used to form a reflective fabric into an enclosure, a light shaft, for the daylight. The light shaft is attached to the roof structures around the roof aperture by the plurality of sections of corner material, thereby suspending the light shaft over the ceiling.

BRIEF DESCRIPTION OF THE DRAWINGS

The objects and many of the attendant advantages of the present invention will be readily appreciated upon consideration of the following specification in relation to the accompanying drawings, in which.

Figures 1A, 1B, 1C, 2:
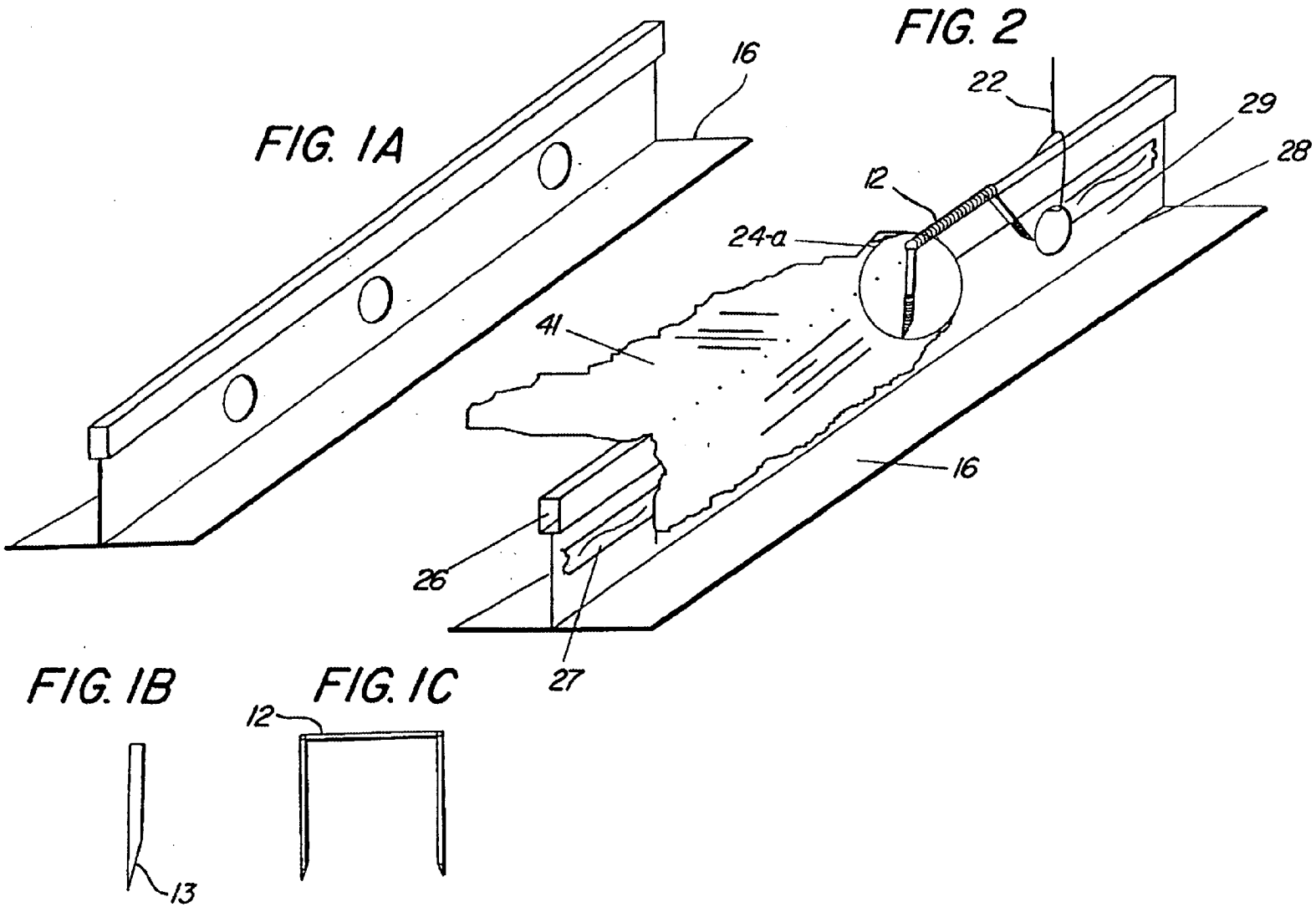
FIG. 1A is an isometric view of a T-bar material used in a suspended ceiling.

Paragraph 1B is an expanded detail of the leg point of the staple in FIG. 1A.

FIG. 1C is a front elevation of an opposed leg staple.

FIG. 2 is an isometric view of a suspended ceiling T-bar and opposed leg staple inserted and spreading into the T-bar bulb to hold a reflective material.

Figure 3A:
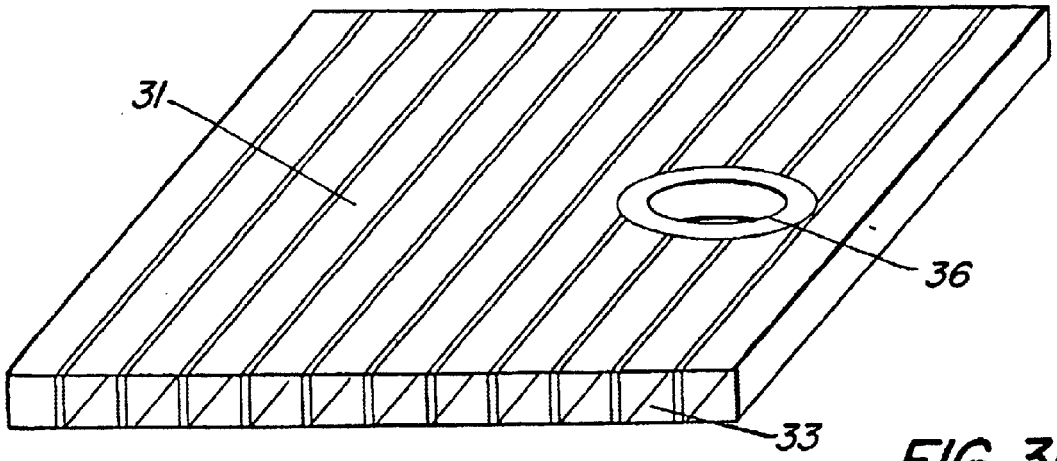

FIG. 3A is an isometric view of a corrugated plastic panel.

Figure 3B:
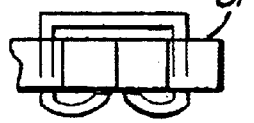

FIG. 3B is a front elevation of a cinch staple inserted into the plastic sheet of FIG. 3.

Figure 4:
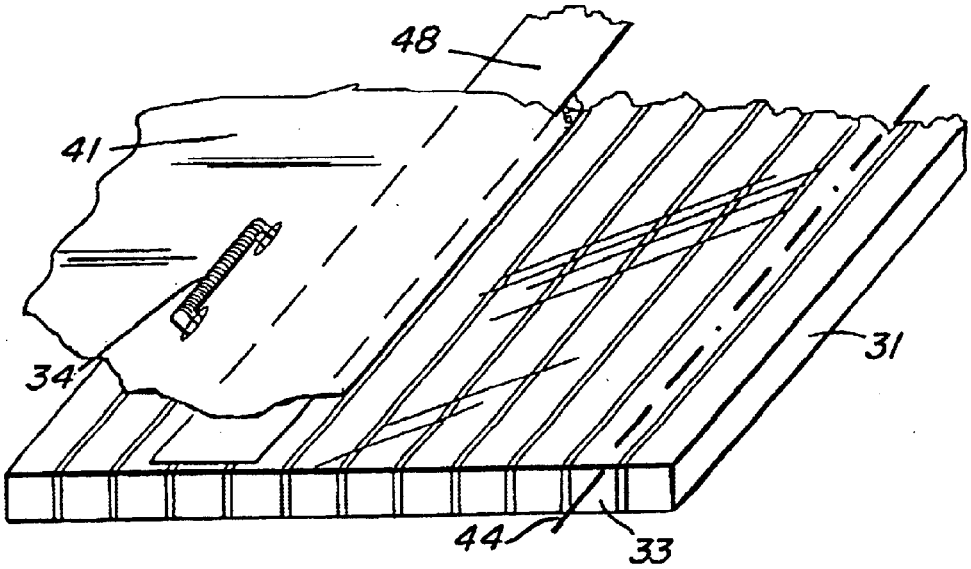

FIG. 4 is an isometric view of a corrugated panel illustrating shaft corner assembly.

Figure 5:
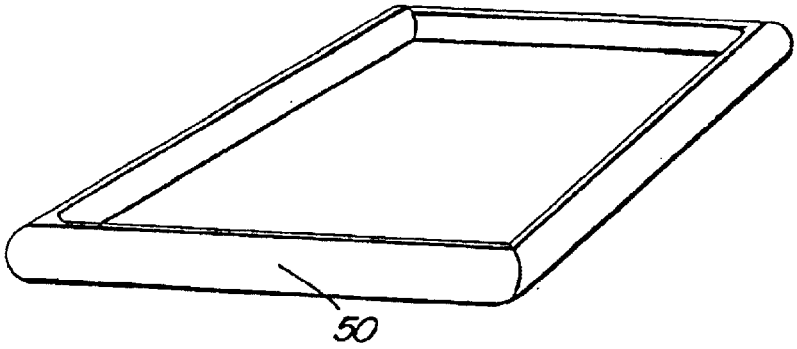

FIG. 5 is an isometric view of a spreader assembly.

Figure 6:
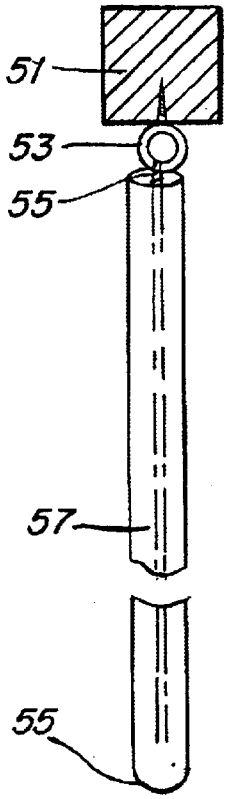

FIG. 6 is a front elevation and partial perspective of a shaft retainer pipe.

Figure 7:
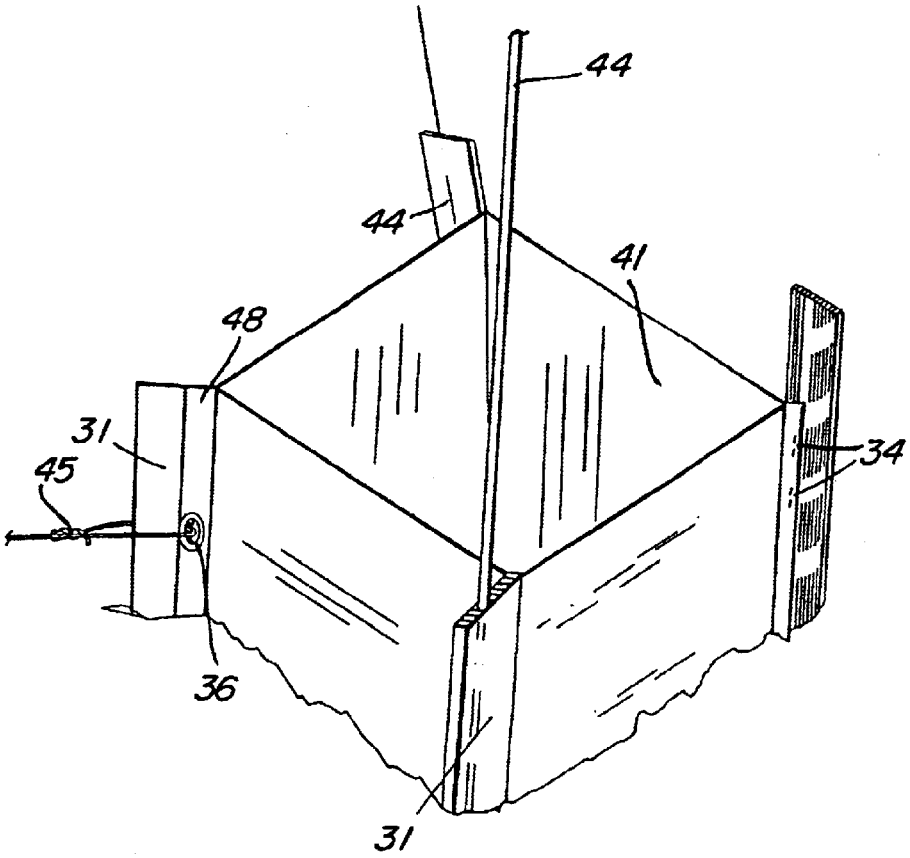

FIG. 7 is an isometric view of a light shaft made with corrugated panels, cut away.

Figure 8:
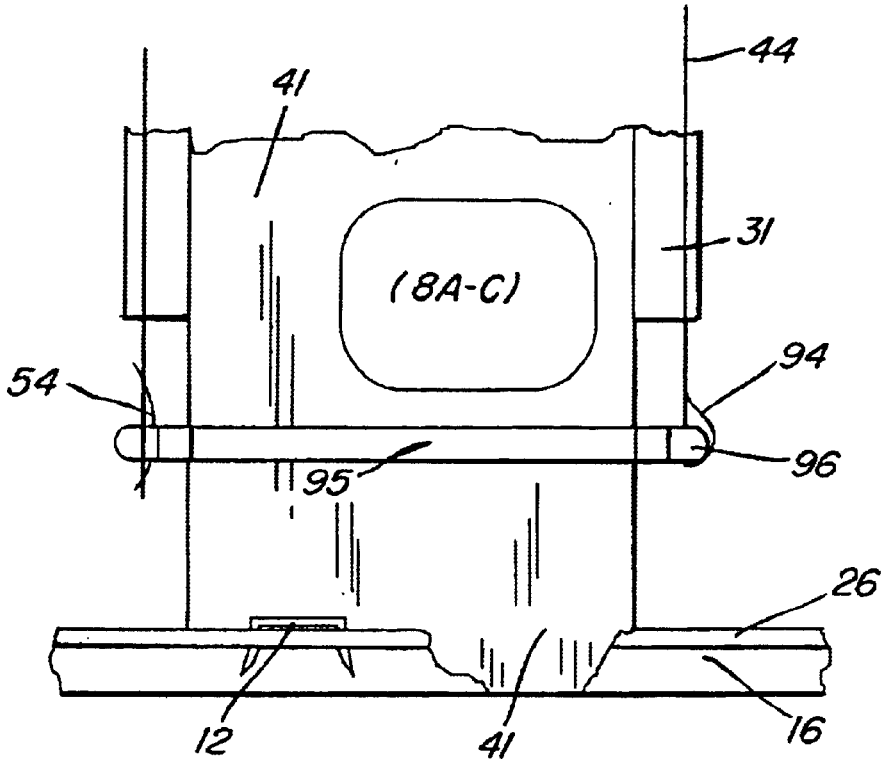

FIG. 8 is a front elevation in partial section of a light shaft with corrugated panel corners.

Figure 8A:
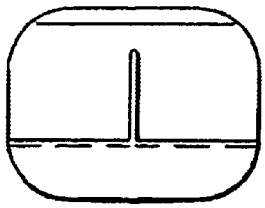

FIG. 8A is a detail of fabric gathering.

Figure 8B:
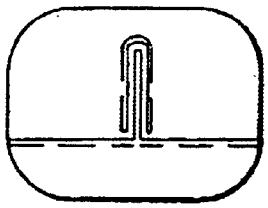

FIG. 8B is a detail of fabric gathering.

Figure 8C:
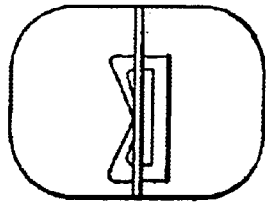

FIG. 8C is a detail of fabric gathering.

Figure 9:
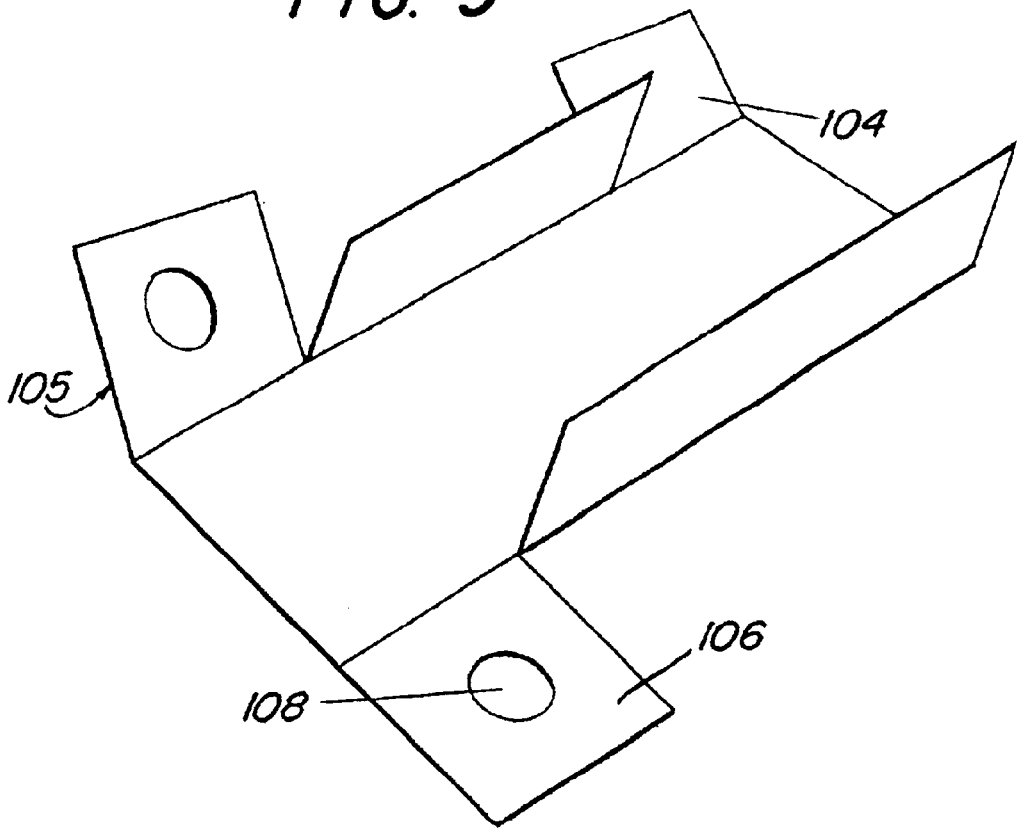

FIG. 9 is an isometric view of a steel channel material used as corners to build a light shaft.

Figure 10:
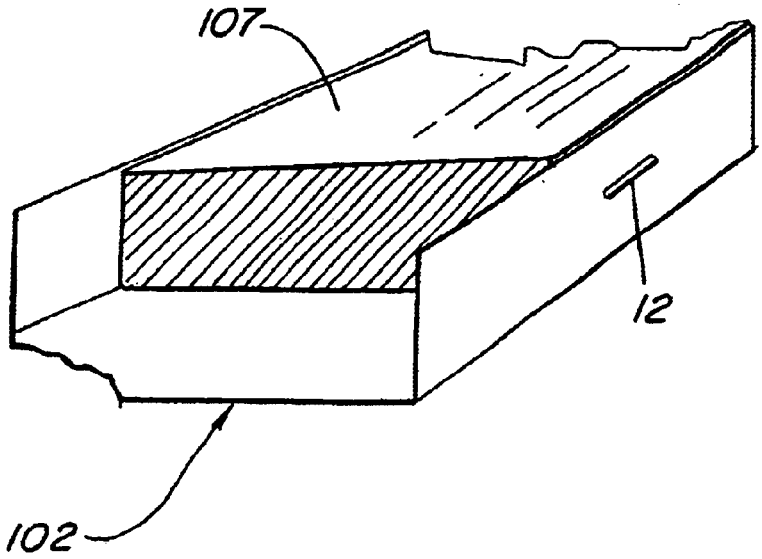

FIG. 10 is an isometric view of an assembled corner channel with an interior support.

Figure 11:
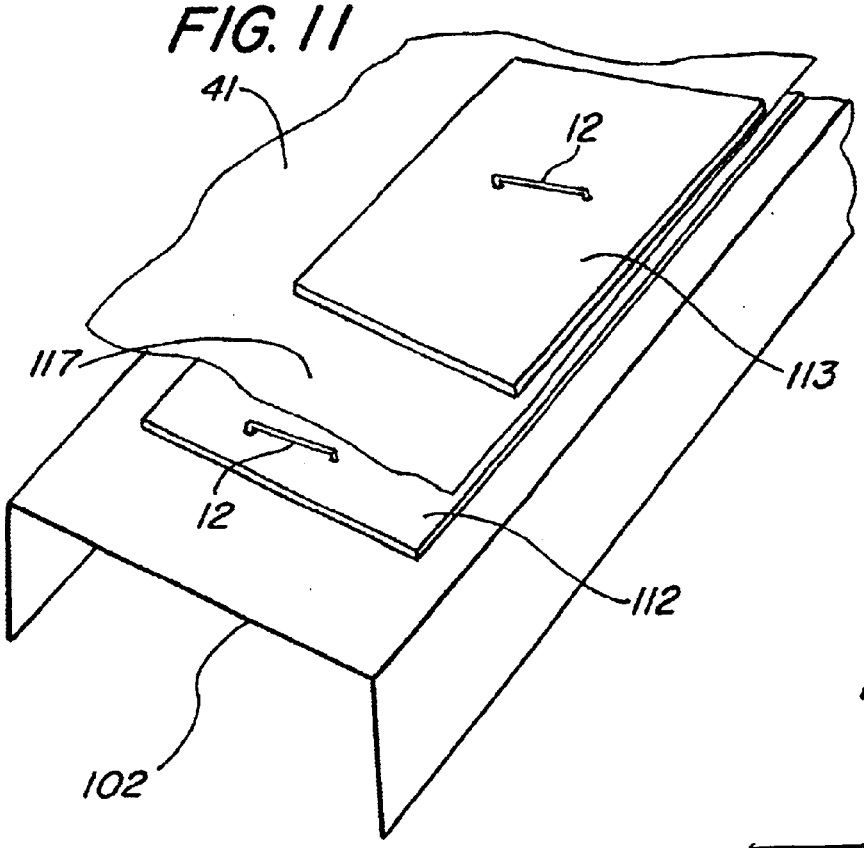

FIG. 11 is an isometric view of a steel channel corner and composite layers at the corner for assembly of a light shaft.

Figure 12:
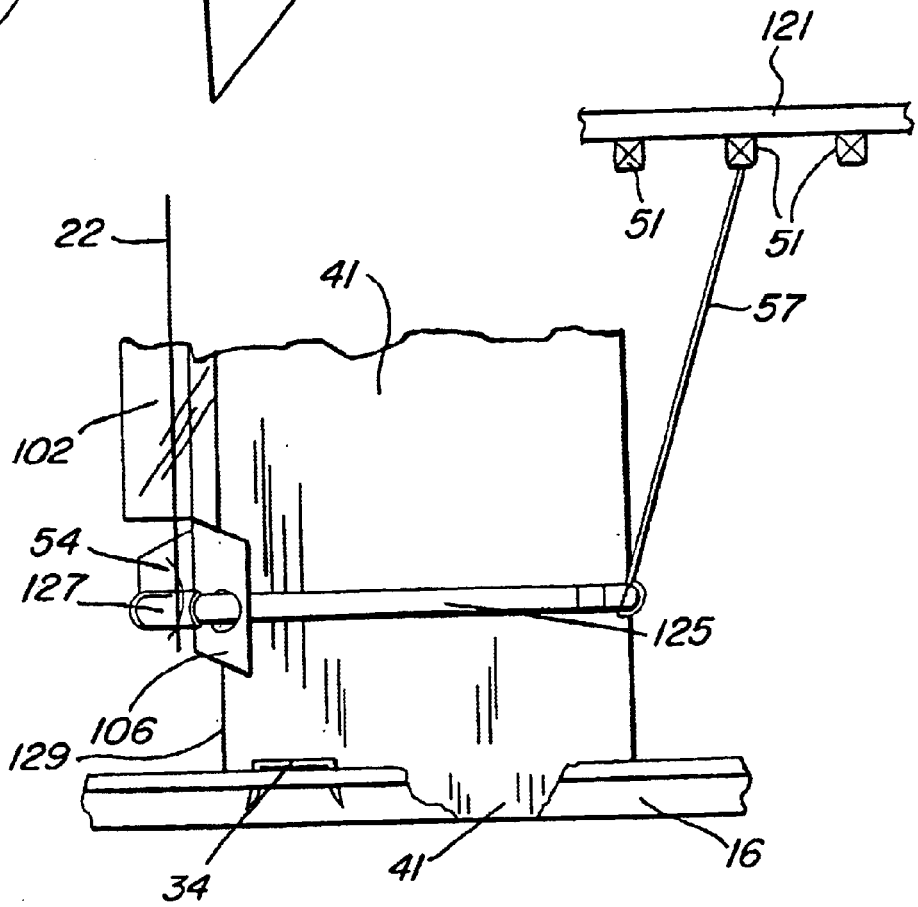

FIG. 12 is a front elevation, partially in section of a light shaft using steel channel corners and a stabilizer pipe.

Figure 13:
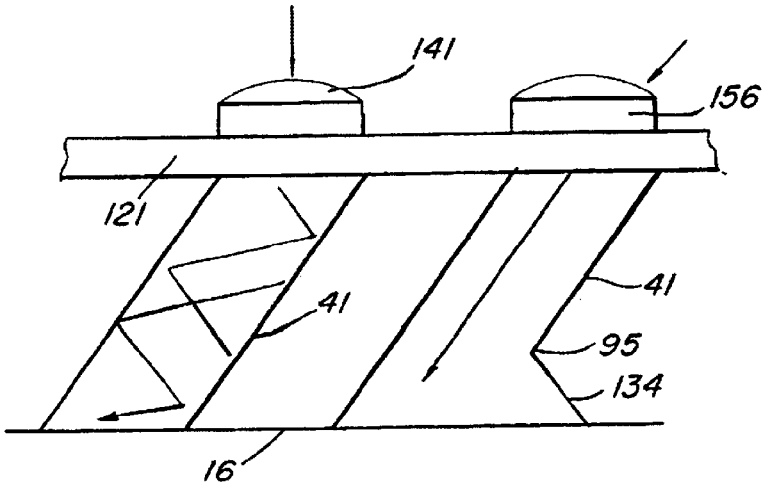

FIG. 13 is a diagram showing an angled enclosure for control of light into the interior.

Figure 14:
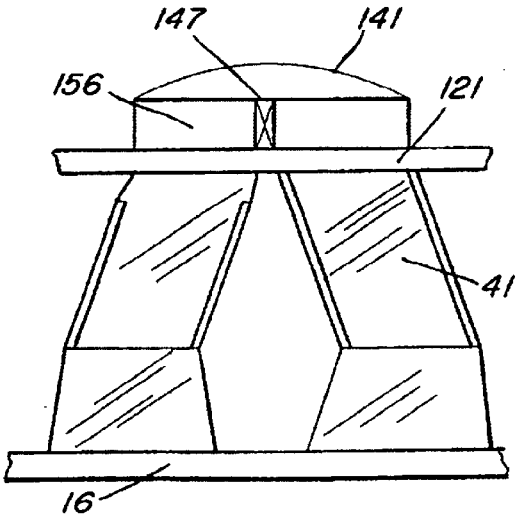

FIG. 14 is a diagram of a split shaft.

Figure 15:
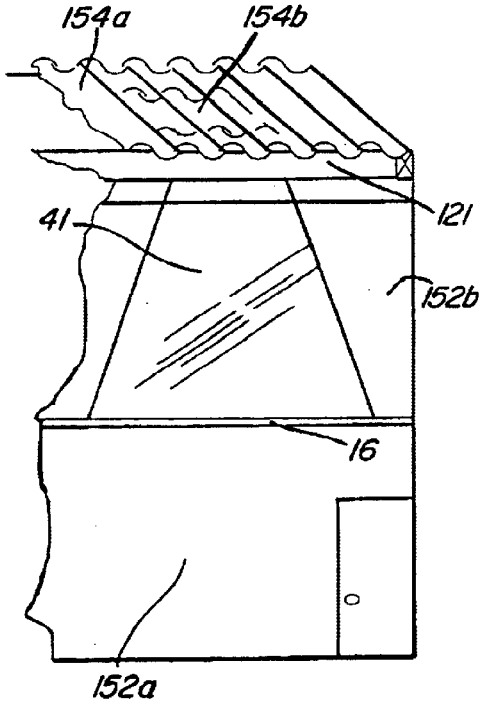
FIG. 15 (PRIOR ART)

FIG. 15 is a diagrammatic illustration of a translucent roof panel.

FIGS. 16A–16D are isometric views of corrugated and channel corner assemblies attached to roof structure.

DETAILED DESCRIPTION OF THE PREFERRED EMBODIMENTS

Typical buildings with suspended ceilings as illustrated in FIG. 15 have a building section 152-*a* and a ceiling to roof section 152-*b*. A light shaft 41 is used for transporting sunlight from outside by way of a skylight 154*b* to inside the building Section 152-*a* through the ceiling to roof Section 152-*b*.

A typical installation, according to the present invention, has a skylight 141 (FIG. 14) located on top of a building roof 121. Situated beneath the skylight is a roof curb 156 making a connection between the skylight 141 and the roof 121. One or more light shafts 41 bring the light to the ceiling 16 of the building Section 152-*a*. Skylight enclosures may be built of different materials and configurations as illustrated in FIGS. 7 and 12, which will be described hereinafter. A single opening at the skylight may be divided into two separate enclosures, as illustrated in FIG. 14, to obtain split enclosures.

The dividing point for split enclosures is located inside the curb 156. A framed member 147 is positioned below the skylight 141 to obtain the split.

Metal roofing material 154-*a* is a common covering material for nonresidential buildings. This type of roofing material is made in many configurations, of many different materials, and finishes. Panels capable of light transmission may be advantageously used for such roofs.

Light transmitting panels 154-*b* are made of various types of glazing materials including fiberglass, polycarbonate, and acrylic plastics. When designed and fabricated, as a replica of the roof material for insertion into metal roofs the requirement for a curb is eliminated. The light transmitting panels are placed under the metal roofing above the roof opening and over the metal roofing below the roof opening. This simplicity of installation, and lack of vertical curb 156 facilitates high rainwater runoff, and ease of retrofitting, for daylighting. These light transmitting panels may be produced in random lengths and in long narrow rectangular shapes.

Light transmitting panels in metal roofs may be constructed to direct daylight for building interiors by choosing the spatial and dimensional characteristics of the roof panels. Long narrow daylighting production at suspended ceilings is obtained by using long narrow panels at the ceiling 16. Compatible, linear transfer at ceilings produces daylight sources capable of length-wise spreading onto interior walls. For example, light shaft 41 in FIG. 15 illustrates an enclosure, located parallel to a building wall. Light shaft 41 terminates at the suspended ceiling 16.

Turning now to FIG. 13, where two light shafts 41 are shown angled between a roof member 121 and a suspended ceiling framework 16. The light shafts of either corrugated panel or channel constructions as will be described hereinafter are typically made of a reflective fabric membrane. The light shafts 41 of FIG. 13 illustrate the distribution of sunlight from summer to winter. The like angled shafts repeat the winter sun angle to provide as much daylighting exposure as possible and provide a cutoff of direct daylight for the summer sun by increasing travel of the light because of reflection off the reflective fabric. This additional travel, besides reducing heat also diminishes ultraviolet rays, because of the additional surface contact.

Light shaft 41 terminates at a finished ceiling frameworks. The ceiling framework may comprise steel T-bar construction with main runners and cross tees. These T-bars (FIG. 2) are usually hung by wires from the roof members, and are supported on the perimeter by connection to building walls. Many other kinds of suspended ceiling products can provide similar terminal points for floating skylight enclosures to connect to.

These types of ceiling frameworks are common in nonresidential markets for separating plenum, the space between the roof and the ceiling, from space below this framework or grid.

Movement and transporting of daylight from the exterior to the interior of the building is accomplished according to the preferred embodiments of the present invention in spite of all plenum obstructions, for a particular application. The first preferred embodiment is utilized when plenums have little mechanical obstruction impacting installation and access to roof and ceiling openings. This first preferred embodiment illustrated in FIG. 8, is a corrugated enclosure light shaft "floating" above the ceiling, and fastened to the roof frame members. FIG. 8 shows the corrugated enclosure 31 floating above ceiling 16. FIG. 12 shows a channel enclosure 102, an alternate embodiment, floating above a T-bar suspended ceiling 16.

These light shaft enclosures attached to a skylight curb 156 at the roof 121 (FIG. 14).

Figure 16A:
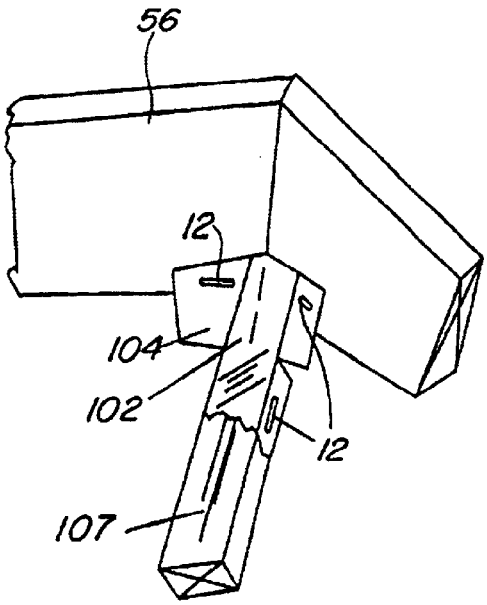
Figure 16B:
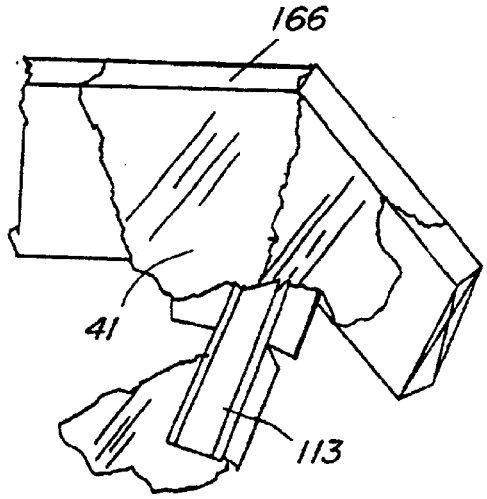
Figure 16C:
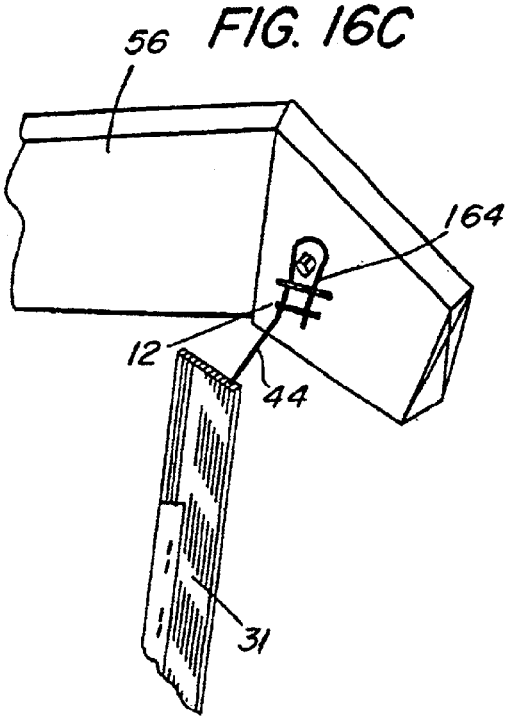

The connections between the light shaft enclosures and the curb 156 of the skylight are detailed in FIGS. 16A–16D. FIG. 16C shows the curb 156 with an enclosure corner wire 44 from a corrugated panel 31 attached to it. The wire 44 is wrapped around a wire anchor 164 and secured to curb 156 by opposed leg staples 12. FIG. 16A shows a channel framework 102 attached to curb 156 by cut and bent flange 104 fastened to the curb 156 with large headed roofing nails. Flange 104 is cut, from the main body of channel 102 and enables the otherwise rigid stud 107 to have movement ability in one direction while the nail provides movement in other directions.

FIG. 1A shows a T-bar 16 which is the main element of a suspended ceiling found in nonresidential buildings. These T-bar sections, that include main runners and cross tees, are supported by wires from roof members above. When assembled, they create a finished ceiling framework known as suspended ceiling grids. The sequence of construction for suspended ceilings starts with a perimeter right angle attachment. Main runners use this perimeter as a base upon which main runner ends sit. Tolerance of installed product grids is in fractions of an inch, making them fragile and susceptible to damage.

The light shaft enclosure floats above these delicate ceiling grids, with minimal weight and connection impact. The possibility of problems or damage to the T-bar grids is thereby greatly reduced. The skylight light shaft enclosure of the present invention unites the suspended ceiling framework and accessories into a daylighting enclosure system.

Installation of the light shaft may start after the suspended ceiling has been installed. In this case, the individual frame members, cross-T's only are removed, particularly when enclosures are angled, or include more than one 2×4 bay. This provides access to the plenum environment where the light shaft enclosures will be erected and hung.

In an alternate approach, light shaft enclosures are constructed and attached, before the suspended ceiling framework is built. The light shaft is permanently attached at its upper end to the roof curb, while the bottom temporally hangs free in approximate location of their final connection to the T-bar suspended ceiling.

Figure 16D:
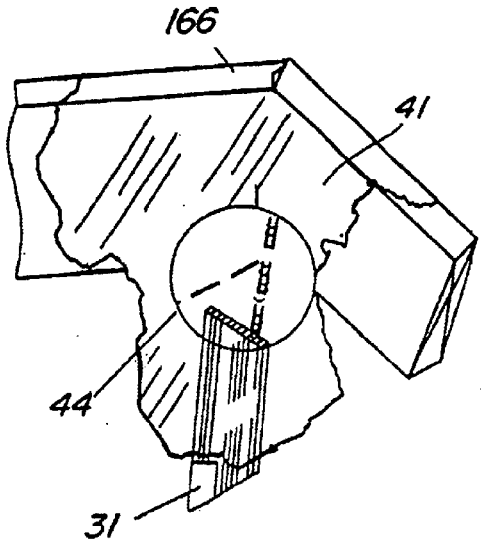

This upper attachment is illustrated in FIGS. 16A–16C with the two preferred embodiments of corrugated panel light shaft and channel light shaft systems in framed and finished form attached to skylight curb 156. FIGS. 16A and 16C show the corner attachment only. FIGS. 16B and 16D show the reflective material of the light shaft 41 wrapped around the skylight curb 156.

FIGS. 1B and 1C show the detail of a pneumatically driven steel staples. The staple 12 illustrated is an opposed leg staple. As can be seen in the magnified detail of FIG. 1B, this staple has a chisel point 13. The inclinations forming the sharp points of this type of staple are opposed. These staples are non-stock items from fastener suppliers, such as Senco Fasteners. Standard roofing staples have tips shaped to form a "V". They are not as sharp, and are designed to penetrate straight into materials being fastened. An extremely sharp point 13 allows the legs of the staple to easily penetrate light gauge metal in conjunction with layers of wood, a benefit described later.

FIG. 2 illustrates the application of the staple 12 for fastening the material of a light shaft 41 to a T-bar 16. The detail 24-*a* of the opposed leg staple shows the staple after it has been fired, from a pneumatic roofing staple gun. The staples enter the bulb 26 of T-bar 16. Positioning staples to be driven directly above and into T-bar bulb 26 causes the legs of the staple to be spread apart because of the sharp angle at the tip of the staple leg, moving the leg away from the staple body. This action of the staple legs allows the staple to capture and securely hold a bottom section of the reflective fabric of the light shaft 41.

The reflective fabric from the light shaft enclosure continues down below the bulb 26 of the T-bar. A utility knife may be used to trim the material along right angle groove 28 of T-bar 26. The fabric end below the bulb 26 is then attached by an adhesive 27 below the bottom edge of T-bar bulb 26. Adhesives of many varieties may be used, such as silicone, two-sided tape, and hot melt glue, for example. Attaching the loose fabric ends of the fabric to the T-bar section below the bulb 26 by an adhesive, creates a dust-tight seal between the inside of the light shaft fabric, and the suspended ceiling framework 16, while maintaining the clearance necessary for placement of light diffuser panels in the T-bar framework.

The use of corrugated panel material 31 to build a light shaft can be seen in FIG. 4. The corrugated panel corner material 31 is used to create the light shaft from reflective fiber to enclose a perimeter space, between roof and ceiling openings, transporting daylight directly and by reflection. Light passed along by the reflective fabric of the light shaft 41 is kept moving, with little loss of light, when material reflectance is within the mid to upper 80% range.

The composition of the reflective fabric used for the light shaft 41 can be made of different base material layers, and have insulating properties. Reflective fabrics with insulating properties increase the energy performance of the light shaft enclosure in relation to plenum-conditioned air. Base sheet materials can be made of fiberglass cloth, scrim mounted vinyl, plain vinyl, or heavy-duty craft paper backing. Applied to these backing sheets, are various quality grades and percentages of thin skin aluminum facings to provide a reflective surface, with highly reflective optical properties. High quality aluminum skins reduce light loss as daylight travels through the light shaft enclosure system. Specialty companies such as Dura Coat Co. manufacture single sheet products. One product is a fiberglass base sheet with a reflective fabric and has a strong resistance to tear and puncture, while also allowing trimming and cutting to be done manually. Production sheet materials are supplied in continuous rolls, in widths up to 54 inches. This common dimension fits the framework openings of grid systems, with small waste. For on-site installations of light shaft enclosures manageable roles are held in dispensers close to the fabric application areas.

Insulating type reflective sheet products are manufactured by Reflectix Insulation. These products provide a dead air space bubble between layers of reflective fabric. Depending on climatic conditions, extra layers of insulated reflective fabric is easily added to the light shaft under construction by either preferred embodiment light shaft enclosure system, corrugated or channel.

When the corrugated enclosure assembly is used to enclose space for daylight, as shown in FIG. 8, the material for the light shaft 41 is fastened to the corrugated sheet material 31, as shown in FIG. 4. Although fastening can be accomplished with physical connections and adhesive techniques, fastening by mechanical application, with clinch staple 34 (FIG. 3), wherein staple legs, when bent over sandwich the body of the staple against corrugated sheet material 31 and contain the reflective fabric for light shaft 41, securing it from moving. Restricting movement of the reflective materials extends its useful life.

To reinforce the connection between the reflective fabric of light shaft 41 and corrugated sheet material 31, adhesives of different compositions, for instance silicone, butyl tape, two-sided carpet tape, are used. The adhesives must be compatible with polycarbonate plastics. Adhesive application 48 bonds the reflective fabric of light shaft 41 onto the corrugated panels 31.

Once the corner members are all attached to the fabric of the light shaft 41, they provide for adjustment of the light shaft to site requirements. As seen in FIG. 4, enclosure corner wire 44 runs through corrugated panel material 31, one of the enclosures for the corners. The corner panels 31 as shown in FIG. 7 provide for spatially locating the light shaft 41. Adjustment of the light shaft on any of the corrugated corner panels 31 is obtained by inserting, corner wires 44 into appropriately located channels 33.

The assembled light shaft may be attached to T-bar hanging wire 22 as shown in FIG. 8, with corresponding wire attachment units 54 designed to provide for anchoring and attaching directly onto hanging wire 22. Grommets 36 (FIG. 7) in the corrugated corner panel 31 may be connected to adjacent wires utilizing simple devices, for creating anchor points. These devices incorporate hanging wires spring clamp 54, or other types of hanging wire fasteners. These perimeter-anchoring devices can be used for positioning and stabilizing the light shaft that has angles and directions not in plumb or normal vertical positions as illustrated in FIG. 14 drawing. These connections, to either side of the light shaft and from above, are used to achieve the designed angles for the light shaft 41.

As illustrated in FIG. 8, spring clamp 54 secures hanging wire at pipe spreader section 95. An alternative for securing angles of skylight light shafts to pipe spreader section 95, would be hanging wires passing through pipe spreader corner 96 and return back up to the wire above the corner section and be tied around and fastened to itself.

Another element used for the final positioning of the light shaft 41 is described in FIG. 5. A roof framing member 51, a supporting framing member of a roof, is used as a fastening point for roof fastener 53. A tension pole wire 55 is connected to and hangs down from fastener 53. Inserted over tension pole wire 55 is a light gauge conduit, tension pole 57. The function of the tension pole 57 is readily understood from FIG. 12 which shows tension pole 57 connected to pipe spreader corner 55 and roof member 51. Securing wire travels back up to roof framing members or spans over to adjacent hanging wires. Spring clamps 54 are used to attach to T-bar hanging wire 22. Correct skylight enclosure positioning is completed, when tension pole wire 55 is secured to its final location.

The corrugated panel corner enclosure material 31 preferred is illustrated in detail in FIG. 3. The corner sheet 31 may be made of differing materials. It could be constructed of paper, cardboard, and many types of plastic. One grade of suitable plastic, having structural characteristics suitable for sheer and tearing resistance, is manufactured by Polygal, General Electric, and other manufacturers of plastic structured sheet products. The plastic structures are preferably polycarbonate extrusions. This type of polycarbonate extrusion is shown in detail in FIG. 3 as having contiguous rectangular channels 33. This sheet material contains divided spaces 33, forming the entire corrugated panel 31. This plastic material has a high strength to weight ratio, when utilized in small sheet widths of 4–6 millimeters. Plus, it has resistance to fasteners or other objects used to penetrate through the sheets, such as clinch staple 34 shown inserted or clenched through sheet panel 31. A grommet 36 fastened into sheet material 31 protects the sheet material opening with reinforcement. For manipulation of the left side corner, as shown in FIG. 7, a wire 45 is required. Polycarbonate panel corners are utilized when building a light shaft as shown in FIG. 7.

The elements shown in FIGS. 1–3 and described above are used to form the completed light shaft assembly. The complete combination of elements is achieved when the fabric or sheet type materials of the light shaft is used to enclose a space between roof and ceiling openings, and transporting daylight as a process of reflection. Light passed along from reflective fabric 41 is kept moving in a vertical inclination when the light shaft assembly 41 encloses space used by daylight, as in FIG. 7.

FIG. 5 illustrates an important part of the floating light shaft system, a pipe spreader 50, for use at the bottom of the light shaft 41. FIG. 8 illustrates the use of a pipe spreader 95 around the light shaft 41 where a spring clamp 54 secures a support wire 44 to pipe spreader section 95. An alternative for securing angles of enclosure 41 at the pipe spreader section 95 would be by wires passing through a pipe spreader corner 96 returning back up to the wire above and there tied around and fastened.

FIG. 8 illustrates the preferred embodiment of using corrugated corner panel material 31 to build the light shaft enclosure 41. Reflective fabric of the light shaft 41 makes up sidewalls of the enclosure when the reflective fabric is clinch stapled 34 through corrugated corner panels 31. Two enclosure corner wires 44, portrayed at opposite corners, are shown. It should be remembered that corner wires 44 would be present in all four corners in an actual enclosure. These wires help to maintain the shape, and necessary tension for the reflective fabric to have smooth sidewalls. The channels 33 in the corrugated panels 31 provide final adjustment choices for wire insertion. The channel (FIG. 4) used in each corrugated corner 31 will be dictated by the actual job site requirements.

Corner wires 44 are also used as raceways to lift a pre-built light shaft enclosure 41 into its finished position. Enclosure lifting is facilitated by grommet 36 in a corrugated panel corner 31, when connected to rope or other pulling devices. Once located in its finished position, manipulation wire 45 can additionally control the light shaft enclosure. As illustrated, manipulation wire 45 is connected to and tied off through a grommet 36. The other end of the manipulation wire may terminate at a hanging wire fastener or a hanging wire spring clamp 54. These spring clamps may be attached to various random T-bar grid hanging wires 22.

FIG. 8 is an illustration of the light shaft 41 as seen from outside. This view shows pipe spreader 95 forming a ring around the outside of the light shaft. This spreader ring maintains a desired shape or configuration at the terminal end of the corrugated corner panel material 31 for the bottom of enclosure corner wires 44. The spreader ring 95 supports the weight, and positioning of the light shaft enclosure. Completion of pipe spreader ring, into a single unit, takes place when pipe spreader corner 96 is permanently attached to the correctly sized pipe spreader section 95 with adhesives, mechanical fasteners or, if plastic, pipe with pipe cement.

Each side of the reflective fabric of light shaft 41 extending below corrugated corner panels 31 is attached to adjoining fabric sides by means of clinch staples 34 through both pieces of reflective fabric corners. This lower stapled section of reflective fabric has complete freedom of movement. Finishing the connection of the fabric to suspended ceiling T-bar 16 completes the entire enclosure of the light shaft 41.

Pipe spreader ring 95, with smooth exterior surface, has no effect upon the integrity of reflective fabric for the light shaft 41 while allowing the reflective fabric to pursue a different path, once it has passed pipe spreader sections 95. Reflective fabric sidewalls of light shaft 41 need existing wrinkles removed. This can be accomplished in the manner illustrated in FIGS. 8A–C. The reflective fabric is shown gathered up, and temporarily clinch stapled in detail view 8A. Detail view 8B illustrates a nylon jacket or overlay of tear-resistant material, draped over the gathered-up portion of reflective fabric seen in detail 8A. FIG. 8C shows reflective fabric and nylon-strengthening jacket clinch stapled together by cinch staple 34. Any one of these methods may be used to create a straight and smooth sidewall of reflective fabric.

Also shown in FIG. 8 are the opposed leg staples 12 securing reflective fabric onto suspended ceiling T-bar 16.

Another preferred embodiment, for the present invention is more suitable when there are more obstructions in the plenum area. The corrugated enclosure system, previously discussed, is best suited for installations that have few mechanical obstructions in the plenum space. A channel corner system is utilized when building plenum's having significant mechanical obstructions. These obstructions may include pipes, wires, ducting and other mechanical elements found in the space between the roof and the suspended ceiling. The obstructions can be accommodated, or absorbed, during construction of a light shaft using the channel corner system when the reflective fabric for the light shaft is cut at the mechanical obstruction location.

Referring to FIGS. 9 and 10, channel framework 102 used for the corners of a light shaft, is illustrated. Found commonly in the construction industry, one type of channel product uses lighter gauges of steel, 20 to 26 gauge. Use of this lighter gauge eases manipulation, increasing productivity in installation. Lighter gauge steel also permits staple penetration, allowing fastening through the steel material in both manufacturing and installation of a light shaft. Penetration is improved when fabric staple 117 (FIG. 11) is either manually or pneumatically driven. This allows for temporary fitting and positioning of each side panel.

FIG. 9 also illustrates the channel framework in various stages of fabrication. The channel material may be cut and bent 104, as shown in FIG. 9, to shape the material as needed at the top end to fit into a skylight curb 156 (FIG. 16A). At the bottom end of the channel, an angled flange 105, 106 is cut and drilled 108 for a pipe spreader 125. A completed assembly is shown in FIG. 12 wherein flange 106, has pipe spreader 125 pass through this hole and the hole in flange 105 to support the light tube.

Assembly of the channel-frame corners with reflective fabric is illustrated in FIG. 11. The bottom element, channel framework 102, is the base foundation upon which backing material 112 for the reflective fabric of the light shaft 41 is mounted. The connection between corner channel 102 and various types of materials including plywood or plastic that may perform as backing for the reflective fabric of light shaft 41, are secured to the channel 102 with opposed leg staples 12. When backing for reflective fabric of light shaft 41 is set, the reflective fabric is temporarily stapled by a light gauge fabric staple 117, either manually or pneumatically driven. This allows for temporary fitting and positioning of each side panel of reflective fabric making up the enclosure walls for the light shaft 41, with minor tension in the fabric, keeping the surfaces smooth and wrinkle free. A batten 113, covered with reflective fabric, secures the edges of each sidewall of adjoining enclosures. This fastening, and binding of fabric is accomplished with opposed leg staples 12, driven by a pneumatic roofing stapler. The sharp points of these staples provide a cutting action for penetration through all four layers. When seated, the legs of the opposed leg staples 12 spread apart, making secure mechanical fastening. Use of the top batten 113 adds extra tension to the reflective fabric enclosure walls, smoothing out fabric wrinkles.

Returning to FIG. 12, the drawing illustrates one completed corner of the channel panel corner system, including a pipe spreader 125, and pipe spreader corner 127. Both provide for positioning and fixing in place, of the light shaft 41. T-bar hanging wire 22 and spring fastener 54 may be used to hold the light shaft in place in a manner as described for the corrugated corner system.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An article of manufacture for transporting daylight through a building plenum from a roof aperture in a roof structure to a building interior aperture in a ceiling structure, the article of manufacture comprising:

a plurality of sections of corner material of a length determined by the path of daylight from the roof aperture to the building interior aperture;

a reflective fabric attached to the plurality of sections of corner material with a section of material extending beyond the length of the corner material, to form a reflective fabric enclosure for the daylight; and an attachment mechanism for attaching each of the plurality of sections of corner material to the roof structure at the roof aperture, thereby supporting the reflective fabric enclosure in suspension over the ceiling structure.

2. The articles of manufacture of claim 1 wherein said plurality of sections of corner material comprise a flat corrugated material.

3. The articles of manufacture of claim 1 further comprising a spreader shaped and sized to circumscribe the outside of the enclosure formed by the reflective fabric and sections of corner material.

4. The article of manufacture of claim 3 wherein the attachment mechanism is a plurality of wires, one for each of the sections of corner material, fastened to the spreader, attached to the sections of corner material and fastened to the roof structure surrounding the roof aperture.

5. The article of manufacture of claim 4 wherein said plurality of sections of corner material comprise a flat corrugated material and wherein each one of the plurality of wires passes through a respective section of corner material.

6. The article of manufacture of claim 5 wherein said plurality of sections of corner material comprise four sections.

7. The article of manufacture of claim 1 her comprising staples for fastening the reflective material extending beyond the length of the corner material to other ceiling structure surrounding the building interior aperture.

8. The article of manufacture of claim 7 wherein the ceiling structure is a suspended ceiling.

9. The article of manufacture of claim 8 wherein said plurality of sections of corner material comprise a channel frame.

10. The article of manufacture of claim 9 wherein the attachment mechanism is the upper end of the channel frame fastened to the roof structure surrounding the roof aperture.

11. The article of manufacture of claim 9 wherein the spreader passes through an aperture at the lower end of each channel frame.

12. The articles of manufacture of claim 11 wherein said plurality of channel frames comprise four frames.

13. The article of manufacture of claim 12 wherein the ceiling structure is a suspended ceiling.

14. The article of manufacture of claim 1 wherein said plurality of sections of corner material comprise a channel frame.

15. The article of manufacture of claim 14 further comprising staples for fastening the reflective material extending beyond the length of the corner material to other ceiling structure surrounding the building interior aperture.

* * * * *